US008716211B2

(12) United States Patent
Geret et al.

(10) Patent No.: US 8,716,211 B2
(45) Date of Patent: May 6, 2014

(54) DETERGENT COMPOSITION

(75) Inventors: Laurence Geret, Pulheim-Stommeln (DE); Clare Louise Jackson, Maidenhead (GB); Gunnar Noding, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 526 days.

(21) Appl. No.: 12/530,529

(22) PCT Filed: Mar. 14, 2008

(86) PCT No.: PCT/GB2008/000896

§ 371 (c)(1),
(2), (4) Date: Feb. 4, 2010

(87) PCT Pub. No.: WO2008/110816

PCT Pub. Date: Sep. 18, 2008

(65) Prior Publication Data

US 2010/0197546 A1 Aug. 5, 2010

(30) Foreign Application Priority Data

Mar. 15, 2007 (GB) ..... 0704933.1

(51) Int. Cl.

| | |
|---|---|
| ***C11D 17/00*** | (2006.01) |
| ***C11D 3/37*** | (2006.01) |
| ***C11D 3/34*** | (2006.01) |
| ***B08B 9/20*** | (2006.01) |

(52) U.S. Cl.
USPC ..... 510/224; 510/375; 510/445; 510/446; 510/475; 134/25.2

(58) Field of Classification Search
USPC ..... 510/224, 375, 445, 446, 475; 134/25.2
See application file for complete search history.

(56) References Cited

U.S. PATENT DOCUMENTS

| | | | | |
|---|---|---|---|---|
| 4,702,857 | A * | 10/1987 | Gosselink | 510/299 |
| 5,786,318 | A | 7/1998 | Lever | |
| 5,789,366 | A | 8/1998 | Lever | |
| 5,837,670 | A * | 11/1998 | Hartshorn | 510/490 |
| 6,017,873 | A * | 1/2000 | Sikra et al. | 510/444 |
| 6,255,274 | B1 * | 7/2001 | Becherer et al. | 510/475 |
| 6,410,500 | B1 * | 6/2002 | Haerer et al. | 510/445 |
| 6,448,212 | B1 * | 9/2002 | Holderbaum et al. | 510/296 |
| 2002/0037824 | A1 * | 3/2002 | Smets et al. | 510/305 |
| 2002/0123441 | A1 * | 9/2002 | Takeuchi et al. | 510/141 |
| 2007/0249515 | A1 * | 10/2007 | Borchers et al. | 510/504 |
| 2010/0197546 | A1 * | 8/2010 | Geret et al. | 510/220 |

FOREIGN PATENT DOCUMENTS

| | | | |
|---|---|---|---|
| WO | 9321294 | A1 | 10/1993 |
| WO | 9502030 | A1 | 1/1995 |
| WO | 9743374 | A | 11/1997 |
| WO | 2006133867 | A | 12/2006 |

* cited by examiner

*Primary Examiner* — Lorna M Douyon
(74) *Attorney, Agent, or Firm* — Norris McLaughlin & Marcus PA

(57) ABSTRACT

The invention provides a solid dishwashing detergent composition comprising an amount of from 0.01 to 10 % wt of one or more anionic polyesters. The compositions exhibit good drying properties, especially on plasticware.

23 Claims, No Drawings

DETERGENT COMPOSITION

This is an application filed under 35 USC 371 of PCT/GB2008/000896.

TECHNICAL FIELD

The present invention relates to detergent compositions which exhibit good drying properties of the items to be cleaned when used in dishwashing applications and especially when used in automatic dishwashers. The drying properties are particularly good on plastic materials. In particular the present invention relates to such detergent compositions comprising polyesters, especially anionic polyesters formed from monomers of terephthalic acid, 5-sulphoisophthalic acid, alkyl diols or polyalkylene glycols, and, polyalkyleneglycol monoalkylethers.

BACKGROUND AND PRIOR ART

As a usual part of a cleaning operation, e.g. for kitchenware, an aqueous composition or water is applied to the cleansed articles to remove the detergent composition employed during a previous cleansing step. This is generally referred to as a rinse step. However, this has the disadvantage of re-wetting the items and in many cleaning operations it is desired that the cleansed items dry as quickly as possible. This is especially true in both manual and automatic dishwashing operations where the time taken for cleaned items, such as kitchenware, to dry is very noticeable. In automatic dishwashing, there is a desire for the items to be dry when the dishwashing machine is opened and if this is not achieved it often leads to dissatisfaction with the cleaning operation. With manual dishwashing it is desired that the cleansed items dry as quickly as possible so that wet items do not need to be left for prolonged periods to dry in the open air.

Achieving rapid drying of cleansed items has been found to be a particular problem for plastic ware as the hydrophilic properties of the plastic often leads to prolonged drying times which is recognised as undesirable.

Therefore, there is a need in the art to provide detergent compositions exhibiting good drying properties. In particular there is a need in the art to provide such detergent compositions which provide good drying properties on plastic items. Furthermore there is a need to provide such compositions which exhibit good stability of the ingredients.

It is an object of the present invention to address one or more of the above-mentioned problems. In particular, it is an object of the present invention to provide detergent compositions that provide good drying of cleansed articles and especially on plastic ware. It is a further object of the present invention to provide detergent compositions that provide good drying of cleansed articles, especially plastic ware, that have been subjected to a manual or automatic dishwashing operation. It is a further object to provide such detergent compositions which exhibit good stability and drying properties for cleansed articles.

It has now been found according to the present invention that certain (anionic) polyesters provide good drying properties especially on plastic ware and most especially in dishwashing applications.

Polyesters produced from dicarboxylic acids, such as terephthalic acid, isophthalic acid, sulphonated aromatic dicarboxylic acids, such as sulphoisophthalic acid, and diols, such as alkyleneglycol, and the use thereof as a Soil Release Polymer (SRP) is well known.

U.S. Pat. No. 4,427,557 describes polyesters of molar weight in the range of from 2,000 to 10,000 g/mole, produced from the monomers; 1) ethyleneglycol, 2) polyethyleneglycol of molar weight ranging from 200 to 1,000 g/mole, 3) aromatic dicarboxylic acids and 4) alkali salts of sulphonated aromatic dicarboxylic acids and their soil release effect on polyester fabrics.

U.S. Pat. No. 4,702,857 discloses polyesters of 1) ethyleneglycol, 1,2-propyleneglycol or mixtures thereof, 2) polyethylene glycol with a minimum of 10 glycol units, terminating at one end in a short-chain alkyl group, specifically a methyl group, 3) a dicarboxylic acid or ester and optionally 4) alkali salts of sulphonated aromatic dicarboxylic acids.

U.S. Pat. No. 4,721,580 discloses polyesters with terephalate units and sulphonic terminal groups, specifically sulphoethoxylated terminal groups $MO_3S(CH_2CH_2O)_n$—H, and describes the use thereof in detergents and softening agents.

U.S. Pat. No. 4,968,451 describes polyesters with sulphonic terminal groups, obtained by the copolymerisation of (meth)alyl alcohol, alkylene oxide, aryldicarboxylic acid and $C_2$-$C_4$-glycol, with subsequent sulphonation.

U.S. Pat. No. 5,415,807 describes the tendency of SRPs with sulphonated polyethoxy/propoxy terminal groups to crystallization, thereby reducing their soil release effect and suggests that the tendency of SRPs to crystallise can be reduced by the addition of hydrotropes.

U.S. Pat. No. 5,691,298 discloses SRPs with a branched backbone structure of di- or polyhydroxysulphonate, terephthalate and 1,2-oxyalkyleneoxy units with non-ionic or anionic terminal groups.

WO 02/18474 describes non-ionic oligoesters which display flow properties and the use thereof for the cleaning of hard surfaces. These oligoesters are unsuitable for solid formulations.

WO 01/23515 discloses anionic polyesters and the use thereof for the cleaning of hard surfaces, wherein these polyesters contain terminal groups which incorporate sulphonic groups. These types of polyesters are viscous, and their use in solid applications is problematic.

EP 1 035 194 describes the potential use of comb-shaped polyesters in cleaning agents and detergents.

EP 964 015 and US 2002 042 354 describe polyesters formulated from the monomers terephthalic acid, 5-sulphoisophthalic acid, ethyleneglycol, polyethyleneglycol, propyleneglycol, polypropylene glycol and polyalkyleneglycol monoalkylether, in which the polyalkyleneglycol monoalkylether is formed of more than 6 glycol units. Polyesters of this type are liquids or viscous solids.

WO 99/09125 discloses washing agents and detergents incorporating polyesters which contain acetal groups and which are liquid at room temperature.

Oligomeric soil release agents comprising terephthalate monomer units for use in fabric care compositions are disclosed in WO 95/02030.

U.S. Pat. No. 5,786,318 discloses soil release agents for a laundry detergent, the agents comprising PEG or end capped PEG.

U.S. Pat. No. 5,789,366 and U.S. Pat. No. 6,255,274 discloses a detergent composition comprising a soil-release polyester comprising monomer units of a terephthalic acid.

WO 93/21294 discloses a detergent composition comprising a polyester comprising dimethylterephthalate.

Previously known anionic SRPs with sulphonic groups generally exhibit good water solubility, but also show a tendency to hygroscopicity and viscosity. The direct grinding of the cooled polyester charge by the use of hammer mills, screen mills or "cylinder mills" is generally not possible. The high uptake of water during the milling process leads to fouling by adhesion and the associated breakdown of continuous operation. Even where acceptable results can be achieved by the use of special, energy-intensive processes such as low-temperature milling (cryo-milling) or spray drying from an aqueous solution, the stability of anionic SRP granulates in storage is limited by their capacity for water absorption.

It is a further object of the present invention to provide detergent compositions which comprise polyesters exhibiting good water solubility, good soil release properties, which remain stable (especially to hydrolysis) in the compositions and which do not adversely affect the stability thereof. These polyesters should show effective and spontaneous water solubility at temperatures below 60° C., and their effects in the compositions into which they are incorporated should be obtained even with a relatively low amount of water. They should also be suitable for formulation as stable granulates, without the substantial consumption of energy.

STATEMENT OF INVENTION

It has been found that one of more of the above problems can be addressed by a detergent composition according to the present invention.

In particular the present invention provides detergent compositions comprising certain anionic polyesters derived from terephthalic acid, 5-sulphoisophthalic acid or a salt of 5-sulphoisophthalic, ethyleneglycol or polyethyleneglycol, propyleneglycol or polypropyleneglycol, and, polyalkyleneglycol monoalkylethers, together with, where applicable, further monomers with 3 to 6 functions which are conducive to polycondensation, specifically acid, alcohol or ester functions.

Thus according to the present invention there is provided a solid dishwashing detergent composition as disclosed herein.

The anionic polyesters used in the detergent compositions of the invention show an improved soil release effect over the known polyester soil release polymers, exceptional dissolution properties and are significantly less moisture-sensitive than conventional polyesters. Their capacity for the formation of granulates having a desired particle size distribution by means of a simple milling process is particularly advantageous.

It is especially preferred that the detergent composition is a dishwashing composition, especially a manual or automatic dishwashing composition. Automatic dishwashing compositions are very preferred according to the present invention.

According to a second embodiment there is provided the use of a dishwashing detergent composition according to the first aspect of the invention in a dishwashing operation, in particular to provide improved drying of cleansed articles.

Surprisingly, it has been found that detergent compositions according to the invention comprising certain polyesters provide good drying properties on articles, especially on plasticware. This has been found to be especially advantageous for dishwashing detergent compositions including both manual and automatic dishwashing detergent compositions. It has also been found that good stability is obtained when the detergent compositions comprise two or more distinct regions and the polyester is predominantly located in a different region to compounds which may affect its stability (e.g. a bleaching compound).

Unless stated otherwise, all amounts herein are given as the percentage by weight of active ingredient based upon the weight of the total composition.

The term "automatic dishwashing detergent composition" as used herein means a dishwashing detergent composition to be used in dishwashing machine.

DETAILED DESCRIPTION

The present invention will now be described in further detail.

The dishwashing detergent compositions according to the invention may be either manual or automatic dishwashing detergent compositions. Especially preferred types of detergent composition according to the present invention are automatic dishwashing detergent compositions.

a) Detergent Composition Format

The dishwashing detergent compositions of the present invention are of a solid form which includes compositions which are in a particulate form (e.g. powder or granules) and shaped bodies. Preferably the composition is in the form of a shaped body.

Solid forms include shaped bodies, for example, the form of a tablet, rod, ball or lozenge. Tablets are especially preferred according to the present invention.

The composition may alternatively be in particulate form, e.g. powder or granulates, may be formed by injection moulding, casting or extrusion. The composition may be encased in a water soluble wrapping, for, example of PVOH or a cellulosic material. The solid product may be provided as a portioned product as desired.

The composition may be homogenous, that is without separate distinct regions. However, it is preferred according to the invention that the compositions comprise two or more distinct regions.

When the composition is an automatic dishwashing product, it is preferably in the form of a unit dose product, i.e. a form which is designed to be used as a single portion of detergent composition in a washing operation. Of course, one or more of such single portions may be used in a cleaning operation.

The compositions of the invention may be made by any conventional method. Suitable methods are well known in the art and do not need to be described in further detail here. For example, detergent tablets may be made by compacting granular/particular material.

b) The Polyesters

The polyester(s) included in the detergent compositions according to the present invention is/are of the type described herein below. Dishwashing detergent compositions comprising these polymers have been found to exhibit good drying properties.

The anionic polyesters used in the compositions of the present invention comprise polyesters containing structural units 1 to 3 or 1 to 4 below:

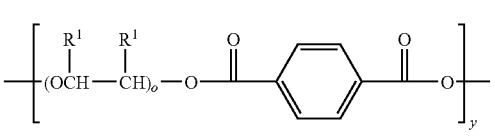

(1)

PET unit

-continued (2)

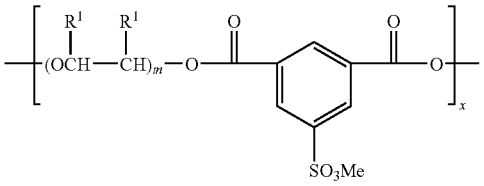

SIP unit (3)

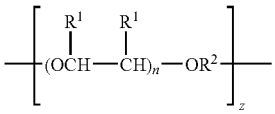

Terminal group (4)

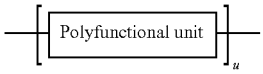

Cross-linking agent in which;

$R^1$ represents either H or a ($C_1$-$C_{18}$) n- or iso-alkyl group, preferably methyl, $R^2$ represents a linear or branched ($C_1$-$C_{30}$)-alkyl group or a linear or branched $C_2$-$C_{30}$)-alkenyl group, a cycloalkyl group with 5 to 9 carbon atoms, a ($C_6$-$C_{30}$) aryl group or a ($C_6$-$C_{50}$) arylalkyl group, m, n, o represent, independently of each other, a number from 1 to 200, x, y and z represent, independently of each other, a number from 1 to 50, with the proviso that x+y≥2 and z>0, u represents a number from 0 to 5, preferably from 0 to 0.5 and specifically from 0 to 0.25, and signifies Me $Li^+$, $Na^+$, $K^+$, $Mg^{2+}$, $Ca^{2+}$, $Al^{3+}$, $NH_4^+$, $C_1$-$C_{22}$-mono-, di-, tri- or tetraalkylammonium or $C_2$-$C_{10}$-mono-, di-, tri- or tetrahydroxyalkylammonium, with the further proviso that the polyester must show a softening point above 40° C. and over 6% solubility by weight in water of 3° German hardness at 20° C.

Preferred polyesters to be used in the compositions of the invention are as defined above wherein $R^1$ is H and/or methyl, $R^2$ is methyl, o, m and n represent a number from 1 to 200, preferably 1 to 20, specifically 1 to 5, most preferably o and m=1, and n represents a number from 2 to 10, x represents a number from 1 to 30, preferably from 2 to 15 and specifically from 3 to 10, y represents a number from 1 to 25, preferably from 1 to 10 and specifically from 1 to 5, and z represents a number from 0.05 to 15, preferably from 0.1 to 10 and specifically from 0.25 to 3.

The polyesters used in the compositions of the invention are obtained by the polycondensation of terephthalic acid dialkylesters, 5-sulphoisophthalic acid dialkylesters, alkyleneglycols, optional polyalkyleneglycols (where m and/or o>1) and unilaterally-terminated polyalkyleneglycols (terminal groups). It should be noted that, where m, n, o>1, a polymer base structure will be present and, accordingly, coefficients may assume any value within the range indicated. This value reflects the numerically average molar weight.

A PET unit (1) within the meaning of the invention is understood as an ester of terephthalic acid with one or more difunctional aliphatic alcohols. Preferred compounds for this purpose are ethyleneglycol (where $R^1$ is H) or 1,2-propylenglycol ($R^1$=H and —$CH_3$) and/or short-chain polyethyleneglycols and/or poly[ethlyeneglycol-co-propyleneglycol] with numerically average molar weights of 100 to 2000 g/mole. Mixtures of ethyleneglycol and propyleneglycol are specifically preferred. In structures according to the invention, each polymer chain may comprise 1-50 PET units. It will clear to the person skilled in the art that, in each case, this value represents a statistical average, with a natural distribution which will vary from system to system.

A SIP unit (2) within the meaning of the invention is understood as an ester of 5-sulphoisophthalic acid with one or more difunctional aliphatic alcohols. Preferred compounds for this purpose will be ethyleneglycol (where $R^1$ is H) or 1,2-propyleneglycol ($R^1$=H and —$CH_3$) or short-chain polyethyleneglycols with numerically average molar weights of 100 to 2000 g/mole. Mixtures of ethyleneglycol and propyleneglycol are specifically preferred. In structures according to the invention, between 1 and 50 SIP units may be present. Here again, the previous remarks regarding statistical distribution apply.

Terminal groups (3) within the meaning of the present invention are classified as all non-ionic, unilaterally terminated polyalkyleneglycol monoalkylethers in accordance with structural unit (3). Preference is given to poly[ethlyeneglycol-co-propyleneglycol]-monomethylethers of average molar weight ranging from 100 to 2000 g/mole and polyethyleneglycol monomethylethers of the general formula: $CH_3$—O—$(C_2H_4O)_n$—H where n≥1 to 99, and preferably n=1 to 20.

Polyesters with polyalkyleneglycol monoalkylethers of the general formula: $CH_3$—O—$(C_2H_4O)_n$—H, where n=2 to 10, are most preferred, especially where n=3 to 5 in the terminal group.

Given that, for the purposes of quantitative conversion, terminal groups will define the maximum average molar weight of the resulting polyester structure, the quantity of structural unit (3) to be used according to the invention will be the quantity required to achieve the above-mentioned average molar weights according to the invention.

In addition to the linear polyesters resulting from the structural units 1-3 described above, cross-linked or branched polyester structures are also possible within the meaning of the invention. This is defined by the presence of a cross-linking, polyfunctional structural unit (4) with a minimum of 3 functional groups and no more than 6 functional groups which are conducive to esterification. Functional groups may include e.g. acid, alcohol, ester, anhydride or epoxy groups. A given molecule may therefore assume different functionalities within the meaning of the invention.

Preferred examples of these functional groups include citric acid, malic acid, tartaric acid and gallic acid and preferably 2,2-dihydroxymethylpropionic acid. Also preferred are multivalent alcohols such as pentaerythrol, glycerine, sorbitol and trimethylolpropane. Also preferred are multivalent aliphatic and aromatic carboxylic acids such as benzol-1,2,3-tricarboxylic acid (hemimellitic acid), benzol-1,2,4-tricarboxylic acid (trimellitic acid), with a specific preference for benzol-1,3,5-tricarboxylic acid (trimesitic acid).

The proportion by weight of cross-linked monomers, in relation to the total mass of polyester, will preferably be in the range from 0 to 10% by weight, specifically from 0 to 5% by weight, and ideally from 0 to 3% by weight.

Polyesters according to the invention, containing structural units 1, 2 and 3 and, where applicable, the cross-linked monomers 4, will generally have numerically average molar weights in the range of 700 to 50,000 g/mole, whereby the numerically average molar weight will be determined by size exclusion chromatography in an aqueous solution, using a closely-distributed polyacrylic acid-Na salt for calibration purposes. It should be noted at this point that all figures for molar weights included in this document relate to the numerically average molar weight, even where this is not specifically indicated.

Numerically average molar weights within the range of 800 to 25,000 g/mole will be preferred, 1,000 to 15,000 g/mole will be specifically preferred and 1,200 to 12,000 g/mole will be ideally preferred.

The molar input quantities of structural unit 3 will be selected such that the numerically average molar weights specified in the invention will be achieved.

The polyesters defined above will have softening points in excess of 40° C., specifically between 41 and 200° C. The softening point will preferably lie between 50 and 200° C., specifically between 80° C. and 150° C., and ideally between 100° C. and 120° C. Polyesters according to the invention are characterized by solubility in excess of 6% by weight in water of 3° German hardness at 20° C. At 30° C., 40° C. and 50° C., solubility will preferably exceed 8% by weight, 40% by weight and 40% by weight respectively, also measured in water of 3° German hardness.

The advantage of the polyesters used in the compositions of the inventions is that, after storage at a temperature of 0° C. to 40° C. over a period of several months, they will retain their pourability and will show little or no adhesion properties. These polyesters also show good solubility in water.

The synthesis of polyesters used according to the invention is completed by a known method, whereby the above-mentioned components, with the addition of a catalyst, are initially heated at standard pressure to a temperature of 160 to approximately 220° C. in an inert atmosphere. Thereafter, the requisite molar weights are formulated in a vacuum at temperatures of 160 to approximately 240° C. by the distillation of superstoichiometric quantities of the glycols used. For this reaction, known esterifying and condensing catalysts from the prior art will be appropriate, including e.g. titanium tetraisopropylate, dibutyl stannic oxide, alkali or earth alkali metal alcoholates or antimony trioxide/calcium acetate. Further details of this process can be found in EP-A-442,101 which is incorporated by reference herein.

A preferred method for the production of polyesters according to the invention is characterized by the condensation of components in a single vessel, whereby the esterifying and condensing catalysts are added prior to heating.

Polyesters used in the compositions according to the invention are of solid consistency, and can easily be milled into powders, or may be compacted or agglomerated to form granulates of a specific particle size prior to their inclusion in the compositions.

The granulation of polyesters according to the invention may proceed by the cooling of the copolymer melting charge formed by synthesis in a cool gas stream, for example air or nitrogen, or advantageously by application to a continuous-feed roller or conveyor belt at a temperature of 40 to 80° C., and preferably 45 to 55° C., to form solidified flocks or flakes. This coarse material may be milled, e.g. in a cylinder mill or screen mill, which may be associated with a screening stage. Granulation may also proceed such that polyesters according to the invention, after hardening, are milled into a powder of particle size <400 μm, and formed thereafter into granulates of specific particle size by compaction or agglomeration.

For special forms of execution, the melting charge or hardened flocks or flakes may be dissolved in water, and aqueous solutions at concentrations of 1 to 99% by weight of polyester in a spray tower, with input temperatures of 150 to 180° C. and output temperatures of 80 to 120° C., may be granulated in a fluidized bed at standard pressure.

The particle size of granulate produced by this method generally lies within the range of 100 μm-2000 μm, preferably 200 μm-1800 μm, and specifically 300 μm-1000 μm. The powder density is of the order of 400 kg/m$^3$.

The detergent compositions of the invention comprise an amount of from 0.01 to 10% wt, more preferably 0.05 to 5% wt, most preferably 0.1 to 3% wt, such as 0.2 to 2.5% wt of the polyester.

When the dishwashing detergent composition comprises two or more distinct regions, e.g. a composition having two or more distinct layers or a core and outer sleeve, the polyester(s) may be wholly or predominantly located in one or more distinct regions. It is preferred that the polyester(s) are predominantly located in one of the two or more distinct regions. By the term "predominantly located" is meant that the component in question is present in a greater amount in that region than in any other region of the tablet.

It is preferred that the distinct region in which the polyester(s) is/are predominantly located comprises at least 60% wt of the total amount thereof present in the detergent composition, more preferably at least 70% wt, even more preferably at least 80% wt, such as at least 90% wt, for example at least 95% wt, better 99% wt and most preferably 100% wt.

c) Optional Ingredients

The dishwashing detergent compositions of the invention preferably further comprise a bleaching compound and according to one embodiment of the invention this is especially preferred.

When the dishwashing detergent composition comprises two or more distinct regions, e.g. as described hereinabove, the bleaching compound may be wholly or predominantly located in one or more distinct regions. It is preferred that the bleaching compound is predominantly located in one of the two or more distinct regions. It is preferred that the bleaching compound and the polyester(s) are predominantly located in separate distinct regions of the composition and it is especially preferred that they are separated into different distinct regions of the composition. This has been found to have the advantage of good stability of the composition.

It is preferred that the distinct region in which the bleaching compound is predominantly located comprises at least 60% wt of the total amount of bleaching compound present in the detergent composition, more preferably at least 70% wt, even more preferably at least 80% wt, such as at least 90% wt, for example at least 95% wt, better 99% wt and most preferably 100% wt.

If the bleaching compound is located in a distinct region in which polyester(s) is/are predominantly located, it is preferred that 10% wt or less of the total amount of bleaching compound, more preferably 5% wt or less, such as 2% wt or less, better 1% wt or less is located in that region and especially that this region is substantially free of the bleaching compound.

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 60 wt %, especially to 55 wt %, most preferably 10 to 50% wt, such as 10 to 20% wt. When the compositions of the invention comprise two or more distinct regions, the amount of bleaching compound typically present in each can be chosen as desired although the total amount of the bleaching compound will typically be within the amounts stated hereinabove.

The detergent compositions may also comprise conventional amounts of detergent builders which may be either phosphorous based or non-phosphorous based, or even a combination of both types. Suitable builders are well known in the art.

If phosphorous builders are to be used then it is preferred that mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

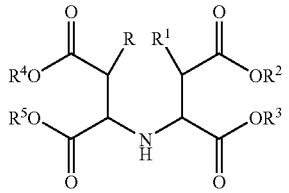

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions of the invention is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %.

The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

The detergent compositions of the invention may contain surface active agents, for example, anionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants is ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_X[CH_2CH_2O]_Y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_X[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_XCH_2CH(OH)CH_2OR^2$$

The use of mixtures of different nonionic surfactants is suitable in the context of the present invention for instances mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surfactants are typically included in amounts of up to 15% wt, preferably of from 0.5% wt to 10% wt, such as 1% wt to 5% wt.

The detergent composition according to the invention may comprise one or more foam control agents. Suitable foam control agents for this purpose are all those conventionally used in this field, such as, for example, silicones and paraffin oil. The foam control agents are preferably present in the composition in amounts of 5% by weight or less of the total weight of the composition.

It is known to include a source of multivalent ions in cleaning compositions, and in particular in automatic dishwashing compositions, for technical and/or performance reasons. For example, multivalent ions and especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Zinc salts are specially preferred corrosion inhibitors.

Therefore, an especially preferred optional ingredient according to the present invention is a source of multivalent ions such as those mentioned in the immediately preceding paragraph and in particular zinc, bismuth and/or manganese ions. In particular a source of zinc ions is preferred. Any suitable source of multivalent ions may be used, with the source preferably being chosen from sulphates, carbonates, acetates, gluconates and metal-protein compounds and those mentioned in the immediately preceding paragraph.

Any conventional amount of multivalent ions/multivalent ions source may be included in the compositions of the invention. However, it is preferred that the multivalent ions are present in an amount of from 0.01% wt to 5% wt, preferably 0.1% wt to 3% wt, such as 0.5% wt to 2.5% wt. The amount of multivalent ion source in the compositions of the invention will thus be correspondingly higher.

The detergent composition may also comprise a silver/copper corrosion inhibitor in conventional amounts. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Polymers intended to improve the cleaning performance of the detergent compositions may also be included therein.

For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

If the dishwashing detergent composition is in the form of a shaped body or a tablet then a conventional amount of a binder material may be included. Any conventional binders may be used, typically in an amount of up to 10% wt, more preferably in an amount of up to 5% wt. Suitable binders include polyethylene glycols.

The detergent composition of the invention may comprise one or more enzymes. It is preferred that the enzyme is selected from protease, lipase, amylase, cellulase and peroxidase enzymes. Such enzymes are commercially available and sold, for example, under the registered trade marks Esperase®, Alcalase® and Savinase® by Nova Industries A/S and Maxatase® by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

The detergent composition according to the invention may comprise a buffering system to maintain the pH of the composition at a desired pH on dissolution and this may comprise a source of acidity or a source of alkalinity as necessary.

A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

The detergent compositions of the invention may also comprise minor, conventional amounts of perfumes, preservatives and/or colourants. Such ingredients are typically present in amounts of up to 2% wt.

The composition is described with reference to the following non-limiting Examples. Further examples within the scope of the invention will be apparent to the person skilled in the art.

EXAMPLES

Example 1

Production of a Polyester to be Used in the Compositions of the Invention

In a 3-liter four-necked flask with a KPG-stirrer, internal thermometer, gas inlet line and distillation bridge, 281.5 g of 1,2-propanediol, 223.4 g of ethyleneglycol, 202 g of tetraethyleneglycol monomethylether, 582.5 g of terephthalic acid dimethylester and 296.22 g of 5-sulphoisophthalic acid dimethylester-Na-salt were combined, and the reaction mixture was rendered inert by the introduction of $N_2$. 1.02 g of titanium tetraisopropylate and 0.8 g of sodium acetate were then added to the reaction mixture in the reverse direction of flow. The mixture was heated slowly in an oil bath such that, at an internal temperature of the order of 120-150° C., the solid components began to melt. The mixture was than heated to 195° C. within 45 minutes, with stirring. Esterification or distillation began at approximately 173° C. Over a three-hour period, the internal temperature was raised to 210° C., until the requisite quantity of condensate for stoichiometric purposes was achieved. The oil bath temperature was then increased to approximately 240-255° C., and the internal pressure was reduced below 20 mbar within 60 minutes. During the four-hour vacuum phase, condensation by the distillation of surplus alcohol was fully completed. During this period, the internal temperature of the polyester melting charge slow rose to 225° C., at the end of the reaction. Aeration was then completed using $N_2$, and the melting charge was transferred to a metal sheet.

Example 2

Production of a Polyester to be Used in the Compositions of the Invention

The process of example 1 was repeated using the ingredients below to produce another polyester to be incorporated into the compositions of the invention;

280.0 g 1,2-propanediol
241.0 g ethyleneglycol
582.0 g terephthalic acid dimethylester
296.0 g 5-sulphoisophthalic acid dimethylester-Na-salt
143.0 g tetraethyleneglycol monomethylether
0.6 g sodium acetate
1.00 g titanium tetraisopropylate

Example 3

Automatic Dishwashing Detergent Composition Comprising a Polyester According to the Invention The particulate compositions used to produce each layer were produced according to the formulations given in table 1 using conventional mixing techniques. The particulate material of the first layer was put into the die and compressed. The particulate material of the second layer was added and compressed on top of the first layer but leaving a recess for a ball to be inserted into the upper face of the second (top) layer. The ball was subsequently inserted to produce dual layer detergent tablets with a ball inserted into the top face of the upper layer. These examples are hereinafter referred to as examples 3b and 3c. Example 3c is the example according to the invention and example 3b is a comparative example. The ball was used in both examples 3b and 3c and was injection moulded and is described in table 1. The amounts of particulate material for layers 1 and 2 were added such that the tablet comprised 77% wt of layer 1, 19% wt of layer 2 and 4% wt of the ball.

All figures in table 1 are given as the percentage by weight of the raw material ingredient based on the weight of that layer i.e. the amounts in each layer total 100% wt. The layers were combined in the following proportions, based on the total weight of the resulting tablet, to produce the final tablets;

TABLE 1

| Raw Material | 3b (comparative) Layer 1 | 3b (comparative) Layer 2 | 3c Layer 1 | 3c Layer 2 | Ball |
|---|---|---|---|---|---|
| Sodium Percarbonate | 14.2 | — | 14.2 | — | — |
| Sodium tripolyphosphate | 48.9 | 47.5 | 48.9 | 47.5 | — |
| Speckles | 0.7 | — | 0.7 | — | — |
| Sodium bicarbonate | — | 0.7 | — | 0.8 | — |
| Sodium carbonate | 22.0 | 13.0 | 22.0 | 9.4 | — |
| Polymer of example 2 (100% active) | — | — | — | 3.6 | — |
| Sodium Disilicate | 1.3 | — | 1.3 | — | — |
| PEG 35000 | — | — | — | — | 54.0 |
| PEG 6000 | 2.0 | 1.5 | 2.0 | 1.5 | — |
| PEG 1500 | 2.4 | 1.5 | 2.4 | 1.5 | — |
| HEDP 4Na | 0.3 | — | 0.3 | — | — |
| Sulphonated Carboxylate polymer | 5.2 | 5.1 | 5.2 | 5.1 | — |
| TAED | — | 16.0 | — | 16.0 | — |
| Enzymes | — | 11.3 | — | 11.3 | — |
| Polyvinyl alcohol | — | — | — | — | 1.7 |
| Fatty alcohol alkoxylate (EO/PO) | 2.6 | 1.0 | 2.6 | 1.0 | 44.0 |
| Benzotriazole | 0.4 | — | 0.4 | — | — |
| Zinc sulphate monohydrate | — | 1.2 | — | 1.2 | — |
| Glycerol | — | 0.2 | — | 0.2 | — |
| Perfume/dye | — | 1.0 | — | 1.0 | 0.3 |
| TOTAL | 100.00 | 100.00 | 100.00 | 100.00 | 100.00 |

To produce formulation 3c, 3.6% wt of the polymer of example 2 above was added to the layer 2 to produce a tablet comprising 0.7% wt of the polymer based on the total weight of the final tablet.

Trials to assess the drying performance of a dishwashing detergent composition according to the invention were carried out. The drying performance of three different compositions/systems was assessed;

3a) a commercially available automatic dishwashing tablet which does not contain any rinse aid, plus, a rinse aid dosed at conventional levels through the dispensing draw of the automatic dishwashing machine.

3b) as in table 1

3c) as in table 1.

The three systems/compositions above were tested to determine their effectiveness on drying performance in an automatic dishwashing machine by washing a selection of articles in a Bosch Logixx 2 automatic dishwashing macine using a 50° C. normal wash cycle and 18° German Hardness water The drying performance of examples 3a-3c in the drying tests is shown in table 2. These results are obtained by measuring the value for the drying performance of each item used in the test and then the average figure is calculated for each example. Thus a value to two decimal places has been calculated.

TABLE 2

| | total | porcelain | glass | cutlery | plasticware |
|---|---|---|---|---|---|
| 3a | 0.64 | 0.63 | 0.78 | 0.88 | 0.23 |
| 3b | 0.22 | 0.08 | 0.83 | 0.36 | 0 |
| 3c | 0.52 | 0.40 | 1.0 | 0.73 | 0.19 |

A result of 1 is the top score which can be obtained and represents a completely dry article with no steaks.

A result of 0.5 indicates one or two drops of water or one wet streak.

A result of 0 indicates more than two drops of water, or one drop and one streak, or two streaks or water in glass or cup cavity.

It is shown that the drying performance of the automatic dishwashing detergent composition example (3c) comprising the polyester of example 2 exhibited good drying performance on a range of substrates and that this performance was generally very similar to a conventional dishwashing operation using a separate detergent and rinse aid (3a). Drying performance of the composition according to the invention (3c) was better than a conventional detergent composition with a built in rinse aid (3b) especially on plastic ware.

The invention claimed is:

1. A solid dishwashing detergent composition comprising an amount of from 0.01 to 10% wt of one or more anionic polyesters comprising structural units:

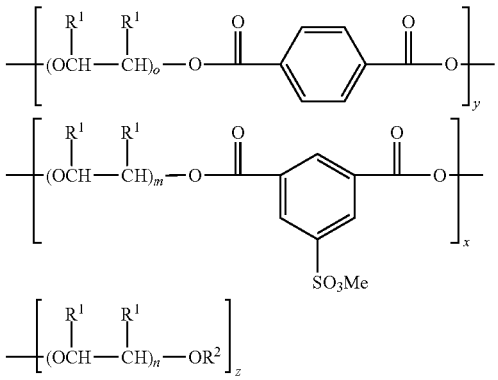

in which;

$R^1$ is H and/or methyl, $R^2$ is methyl, m and o represent, independently of each other, a number from 1 to 200, n represents a number from 1 to 5 x represents a number from 1 to 30, y represents a number from 1 to 25, and z represents a number from 0.05 to 15, with the proviso that x+y≥2 and z>0, and wherein, the polyester exhibits a softening point above 40° C. and over 6% solubility by weight in water of 3° German hardness at 20° C.

2. A dishwashing detergent composition according to claim 1, wherein m and o represent a number from 1 to 5.

3. A dishwashing detergent composition according to claim 1, wherein o and m=1, and n represents a number from 1 to 5.

4. A dishwashing detergent composition according to claim 1, wherein x represents a number from 2 to 15.

5. A dishwashing detergent composition according to claim 1, wherein y represents a number from 1 to 10.

6. A dishwashing detergent composition according to claim 1, wherein z represents a number from 0.1 to 10.

7. A dishwashing detergent composition according to claim 1, wherein the polyester has a softening point between 41° C. and 200° C.

8. A dishwashing detergent composition according to claim 7, wherein the polyester has a softening point between 80° C. and 150° C.

9. A dishwashing detergent composition according to claim 1, wherein the composition is an automatic dishwashing detergent composition.

10. A dishwashing detergent composition according to claim 1, comprising 0.05 to 5% wt of the one or more polyesters.

11. A dishwashing detergent composition according to claim 1, wherein composition is in the form of a shaped body.

12. A dishwashing detergent composition according to claim 11, wherein the shaped body is a tablet.

13. A dishwashing detergent composition according to claim 1, wherein the composition comprises two or more distinct regions.

14. A dishwashing detergent composition according to claim 13, wherein the polyester is predominantly located in one of the two or more distinct regions.

15. A dishwashing detergent composition according to claim 1, wherein the composition further comprises a bleaching compound.

16. A dishwashing detergent composition according to claim 15, wherein the bleaching compound is present in an amount of from 1 to 60 wt % based on the total weight of the composition.

17. A dishwashing detergent composition according to claim 15, wherein the bleaching compound is selected from the group consisting of inorganic peroxides and organic peracids, derivatives thereof and mixtures thereof.

18. A dishwashing detergent composition according to claim 13, wherein the bleaching compound is predominantly located in one of the two or more distinct regions.

19. A dishwashing detergent composition according to claim 15, wherein the bleaching compound and the polyester (s) are predominantly located in separate distinct regions of the composition.

20. A dishwashing detergent composition according to claim 15, wherein the bleaching compound is located in a first distinct region and the polyester is located in a second distinct region.

21. A dishwashing operation comprising the step of: supplying a dishwashing detergent composition according to claim 1 to an automatic dishwashing machine.

22. A method for providing improved drying of cleansed articles which comprises the step of: supplying a dishwashing detergent composition according to claim 1 to an automatic dishwashing machine.

23. A method for cleaning plasticware in a dishwashing operation comprising the step of: supplying a dishwashing detergent composition according to claim 1 to an automatic dishwashing machine.

* * * * *